United States Patent [19]

Léhmann

[11] 4,000,900

[45] Jan. 4, 1977

[54] CUE-GAME AND SLIDING DISK FOR SAME

[76] Inventor: Cyrill George Léhmann, Grenljusbacken 21, X, 117 45 Stockholm, Sweden

[22] Filed: Jan. 10, 1975

[21] Appl. No.: 540,132

[30] Foreign Application Priority Data

Jan. 28, 1974 Sweden ..... 7401086

[52] U.S. Cl. ..... 273/126 R; 273/128 R

[51] Int. Cl.[2] ..... A63F 3/00

[58] Field of Search ..... 273/126 R, 126 A, 128 R, 273/128 CS, 128 A

[56] References Cited

UNITED STATES PATENTS

| | | | |
|---|---|---|---|
| 202,318 | 4/1878 | Witsil | 273/126 R |
| 733,644 | 7/1903 | Haskell | 273/126 R |
| 1,167,452 | 1/1916 | Ward | 273/126 R |
| 3,156,467 | 11/1964 | Rucker | 273/126 R |
| 3,784,204 | 1/1974 | Felber | 273/128 R |

FOREIGN PATENTS OR APPLICATIONS

| | | | |
|---|---|---|---|
| 57,320 | 5/1912 | Switzerland | 273/126 R |
| 345,960 | 3/1931 | United Kingdom | 273/126 R |

*Primary Examiner*—Richard C. Pinkham
*Assistant Examiner*—T. Brown
*Attorney, Agent, or Firm*—Eric Y. Munson

[57] ABSTRACT

A cue-game comprising a table edged by uncushioned solid rails, and a number of sliding, generally cup-shaped, circular disks to be shot over said table by means of a cue. Each sliding disk has a resilient, skirt-like flange portion to bounce well and a height substantially exceeding that of the table rails. The inner walls of the table rails lean slightly inwards over the smooth and hard table surface.

11 Claims, 5 Drawing Figures

CUE-GAME AND SLIDING DISK FOR SAME

BACKGROUND OF THE INVENTION

This invention is basically concerned with a cue-game of the kind comprising a table surrounded by solid, uncushioned walls, a number of disks adapted for sliding movement on said table, and at least one cue for shooting said disks over said table, and in which each of said disks comprises a circular body having an upper side and a lower side and a total height that is considerably less than the maximum body diameter, the body showing said maximum diameter only within a circumferential narrow zone that is vertically spaced from both the uppermost and the lowermost surface portions of the body. In other words, the invention is concerned with a game of skill somewhat resembling billiards but played not with balls but with a special kind of disk-like sliding pieces. In addition, the invention relates to a sliding disk or piece for use in such a cue-game.

In previously known games of the kind referred to, each sliding disk was a fully symmetrical, circular and frequently annular, solid body having a more or less convex rim generatrix and its maximum diameter as well as its center of gravity in an imaginary plane through half its height. However, game disks of this kind are easily overturned, wabbled and even inverted when played and they bounce badly when hitting the table walls or one another. For this and other reasons the known games of the kind in question do not permit an accurate and qualified play, in which the skill of the players becomes really decisive, as is the case in ordinary billiards.

SUMMARY OF THE INVENTION

Accordingly, it is an object of the present invention to provide an improved but still reasonably simple and cheap game of the kind referred to hereinbefore, in which the disks will slide and bounce with excellent ease and accuracy, whereby a very advanced play can be performed and the skill of the players will be thoroughly and fairly tested.

Another object of the invention is to provide an improved game of the kind referred to, in which the disks can be easily reached and properly actuated by the cue, whereever they happen to come to a halt on the table within the surrounding walls or rails thereof.

A further object of the invention is to provide an improved game of the kind referred to, in which the disks, when bouncing after having hit any one of the table enclosing walls, will show no tendency of skimming over the table surface in a fluttering manner but will continue to slide smoothly and steadily in an accurate direction of rebound.

With these and other objects in view the invention suggests in a cue-game of the kind already referred to the improvement that said zone of maximum body diameter of each disk is on the outside of a substantially vertically extending and radially resilient annular flange portion of the disk body and that the height of the table walls is considerably less than the total height of said disks, preferably only about half that height.

BRIEF DESCRIPTION OF THE DRAWINGS

For further elucidation of the invention some preferred embodiments thereof will now be described with reference to the accompanying drawing, in which.

DESCRIPTION OF PREFERRED EMBODIMENTS

Figure 1:
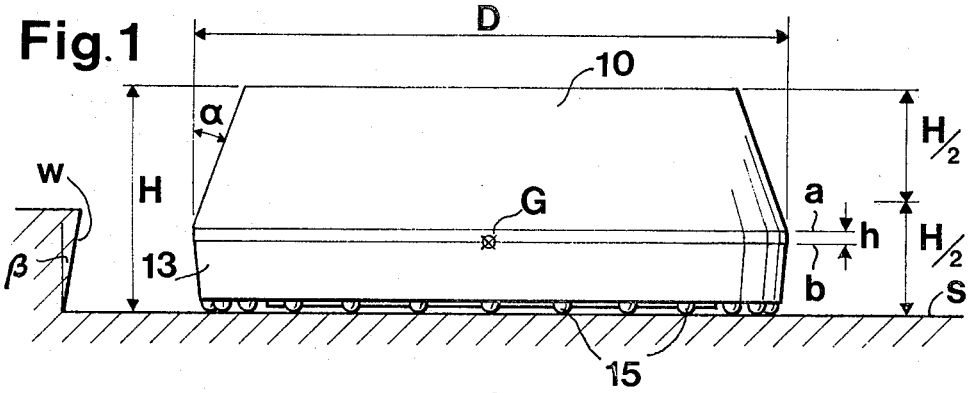
FIG. 1 is a side view of a first form of a sliding disk and at the same time a fragmentary sectional elevation of cue-game table, on which the disk is adapted to be slidably moved, the table being provided with a surrounded border rail or wall.
Figure 2:
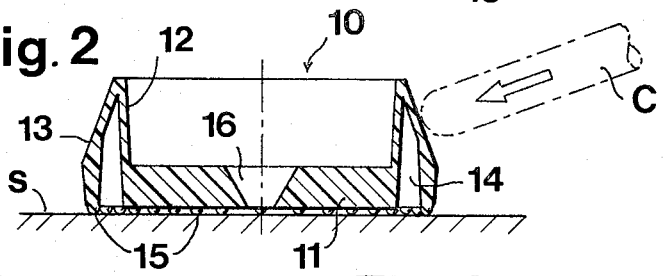
FIG. 2 is a sectional elevation of the disk of FIG. 1 on a reduced scale.
Figure 3:
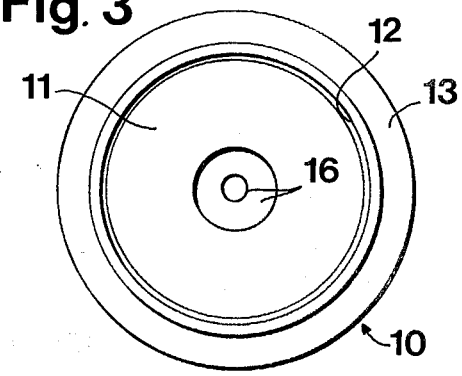
FIG. 3 is a plan view of the disk in FIG. 2 as seen from above.
Figure 4:
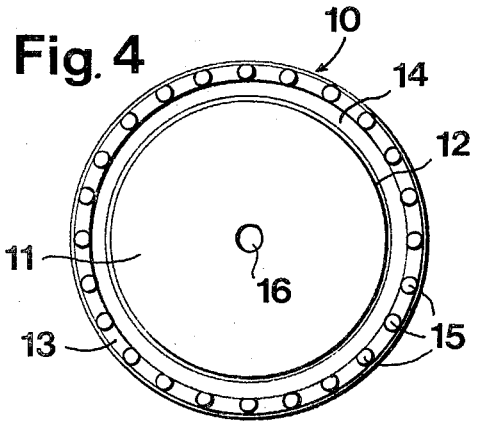
FIG. 4 is a plan view of the disk in FIG. 2 as seen from below.

A cue-game according to the invention includes a smooth and hard table S surrounded by uncushioned, i.e. rigid and solid, border rails or walls W, at least one cue C and a number of sliding disks or pieces. Commonly the game is played with at least three such disks, which are preferably structurally identical but frequently differently colored, and usually one of them is the cue-disk. Each disk comprises a circular body having an upper portion and a lower side and a maximum outer diameter D that is considerably greater than the total height H of the body. The maximum body diameter D is found within a circumferencial narrow zone *h*, the upper limit *a* of which is below half the total height H/2 of the body and the lower limit *b* of which is vertically spaced from the lowermost surface portions of the body.

The outer diameter of the upper part of the body above the upper limit *a* of zone *h* decreases progressively upwards, and the center of gravity G of the body is below said upper limit *a*. Furthermore, the generatrix of the annular outer surface of the upper part of the body, which forms in fact a cue-striking surface portion, is inclined inwardly towards the axis of the body in such a manner that the upper part of the body will be, at least approximately, a frustum of a cone or a frustum of a spherical cap, the generatrix forming, at least with a substantial part of its length, an angle $\alpha$ of not less than 15°, and preferably about 20–30° , to the axis of the body.

The foregoing description is common to all disks used in a game embodying the invention and, consequently, also to the two forms of such disks to be described in the following.

The disk 10 illustrated in FIGS. 1–4 is particularly adapted for being molded as one single piece in a two-part mold or die, for instance of hard plastics or other hard but resilient molding material. As seen from FIG. 2 the disk body 10 is generally shaped as a circular cup having a thick bottom portion 11 and a surrounding, hollow wall portion which is formed by an inner flange member 12 extending upwardly from the circumference of the bottom member 11 in a slightly conical manner, and an outer flange portion 13 extending generally downwardly somewhat like a skirt from the brim of the inner flange portion 12. Between the two flange portions 12 and 13 there is a downwardly opening, substantially V-shaped annular groove 14. On the ring-shaped lower edge of the outer flange portion 13 there are a plurality of uniformly spaced, substantially semi-spherical warts 15, the downwardly facing tips of which are a short distance below the lower side of the bottom member 11. These warts form an annular series of supporting points, on which the body can slide with a minimum friction on the smooth but hard top surface of the table S. The bottom portion 11 has a central aperture 16 therein, which conically decreases in diameter in the downward direction and the lowermost opening of which is quite close to the table surface. This aperture 16 permits an accurate determination of the position of the sliding disk in relation to possible markings on the table top surface.

The configuration of the external circumferential face of the outer flange portion 13 is so chosen that the disk will show its maximum diameter D within a circumferentially extending, rather narrow zone *h*, within which the body is substantially cylindrical. Above the upper limit *a* of this zone *h* the body 10 or, more accurately, the upper part of the flange portion 13, tapers in the upward direction like a frustum of a cone having a cone angle $\alpha$ ranging approximately between 15° and 20°. Below the lower limit *b* of the zone *h* the body tapers downwardly at a slightly lesser angle of clearance, say 1°–5°. Thanks to the cup-shape of the body a low center of gravity is obtained, and thanks to the annular groove 14 the outer flange portion 13 will show certain resilient qualities contributing to a good bouncing ability of the disk. By reason of the external conical shape of the upper portion of the body it is assured that the blows imparted to the disk by means of a cue C during the play will always produce a force combination including a downwardly directed component and a horisontally directed driving component. This fact, combined with the low center of gravity of the body and the spread out contact between the body and the table S provided by the warts 15, will assure a very stable position of the disk at rest as well as during sliding over the table surface.

As mentioned before, the table S is provided with an upstanding or elevated rail or wall W all around (FIG. 1). The height of this rail does not need to appreciably exceed the height at which the upper limit *a* of the zone *h* of the disk is located, which means that a substantial part and usually almost half the total height H of the disk will be above the upper surface of the rail of wall W. This makes it possible to easily reach and strike each disk on the table with the cue C irrespective where the disk happens to stop on the table surface. If during the play the disk touches one of the table walls W, this will happen within the zone *h*, below the upper limit *a* of which the center of gravity G of the body is situated. Accordingly, the disk will show no tendency to overturn when colliding with the table walls, and the same is true if the disk collides with other obstacles or other disks on the table, provided, of course, that all disks have their maximum diameter within a zone that is on the same height or level on all of them.

Figure 5:
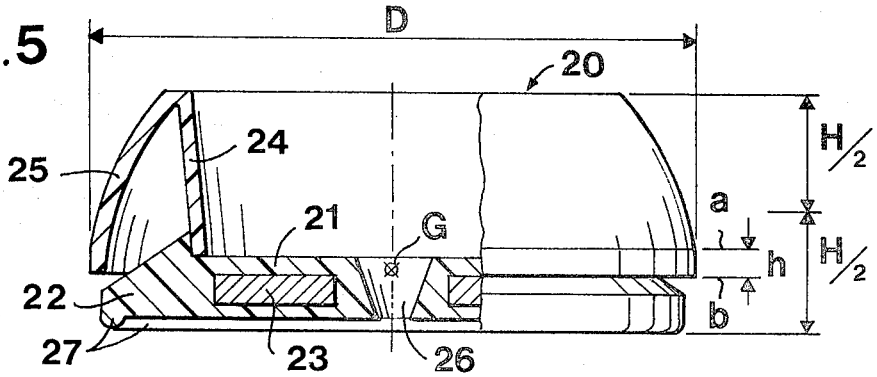
FIG. 5 is a side view, partly in section, of a second and preferred form of a cue-game sliding disk embodying the invention.

The variant 20 of the sliding disk shown in FIG. 5 is composed of several parts, and the external shape of its upper part is a frustum of a spherical cap. The disk body 20 consists of a base plate 21 having a thickened marginal portion 22. A metallic washer 23 may be embedded in the base plate 21 but is mostly not needed. Secured to the base plate 21 is an annular upper portion, the cross section of which almost takes the form of an inverted V, having an inner flange portion 24, the lower edge of which is attached to the base plate, and a skirt-like outer flange portion 25 which has a free lower edge and is thus resilient. The external face of the lower margin of the outer flange portion 25 is cylindrical within the zone *h*, which is well below half the total height H of the disk body. The base plate 21 has a conical center aperture 26 and slides on a supporting bead 27 formed around the margin of the lower side face of the marginal portion 22.

Practical tests have shown that, at least in those forms of the sliding disk which have here been shown and described, it is suitable to choose the relation between the total height H and the maximum diameter D of the disk body less than 1:2 and preferably in the neighbourhood of 1:3. The middle of the zone *h* can suitably be at one third of the total height H counted from below, and the width of the zone *h*, i.e. its extent in the vertical direction, can be varied from almost nil to about 20 % of the height H.

In practice, the disks 10 or 20, may, for instance, have a maximum body diameter D of approximately 50 millimeters, a height H or approximately 18 millimeters and a weight of about 15 grammes, but these data are in no way critical. The table S may then have a dimension of say from 50 × 100 centimeters to 100 × 200 centimeters or more, and the height of the surrounding rails or walls may be 10–12 millimeters.

To prevent uncontrolled jumping or wabbling movements of the disks when they hit the walls of the table and bounce, it has been found desirable to lean the active, inner wall face W of the table rails inwardly over the table at a small angle $\beta$, preferably in the order of 5°–15°, as shown in FIG. 1, said angle $\beta$ being always smaller than the angle $\alpha$ referred to in the description of the disk. The table top surface S within the rails or walls W may, of course, be provided with any desired markings.

I claim:

1. A sliding game piece comprising a circular, generally disk-shaped body having uppermost and lowermost surfaces and a total height defined by said uppermost and lowermost surfaces that is less than half of its maximum body diamater, said maximum diameter being confined within a circumferential relatively narrow zone of said body that is vertically spaced from both said uppermost and said lowermost surfaces, said narrow zone having upper and lower limits, the upper limit of said narrow zone being located at a level below the one-half level of said total height of said body, said body including a central body portion having uppermost and lowermost surfaces, and an annular outer skirt portion encircling said central body portion and extending outwardly and downwardly from said uppermost surface of said body to said upper limit of said narrow zone to define a resilient sleeve surrounding at least a portion of the height of said central body portion in radially spaced relationship thereto, said narrow zone of maximum body diameter being a part of said sleeve.

2. A sliding game piece according to claim 1, wherein said central body portion has the shape of an open cup, said skirt extending from the brim thereof, said cup having an inside depth exceeding one-half the total height of said body.

3. A sliding game piece according to claim 2, wherein a central through-passing aperture is provided in the bottom of said cup-shaped central body portion, said aperture being of a diameter smaller than the maximum body diameter.

4. A sliding game piece according to claim 1, wherein said generally disk-shaped body has a center of gravity that is below the upper limit of said zone of maximum body diameter.

5. A sliding table cue-game piece according to claim 1, wherein said central body portion forms the lowermost surface of the body, and said sleeve has a free lower edge that is vertically spaced from said lowermost surface portion.

6. A sliding piece for use with a game table having upstanding rebound walls and cue-type game piece projector comprising a circular, generally disk-shaped body having uppermost and lowermost surfaces and a total height defined by said uppermost and lowermost surfaces that is less than one-half of its maximum body diameter, said body having its maximum diameter confined within a circumferential relative narrow zone that is vertically spaced from both the uppermost and the lowermost surfaces of said body, said narrow zone having upper and lower limits, said upper limit of said narrow zone being located at a level below the one-half level of said total height of said body and forming a caroming surface for said game piece, said body including a central portion having uppermost and lowermost surfaces, and an annular outer skirt portion encircling said central body portion and extending outwardly and downwardly from said upper surface of said body to said upper limit of said narrow zone to define a resilient sleeve surrounding at least a portion of the height of said central body portion in radially spaced relationship thereto, said narrow zone of maximum body diameter being said caroming surface and the surface of said sleeve lying between said uppermost surface of said body and said upper limit of said narrow zone being of upward tapering configuration and defining a cue-striking surface above said narrow zone.

7. A sliding table cue-game piece according to claim 6, wherein said cue-striking surface slopes towards the geometrical vertical axis of the circular body at an angle of at least 15°.

8. A sliding table cue-game piece according to claim 6, wherein said central body portion is shaped as an open cup having an inside depth exceeding one-half the total height of the body and a bottom in which a through-passing central aperture is provided.

9. A sliding table cue-game piece according to claim 8, wherein said central aperture passing through said cup-shaped bottom is frusto-conical with a downwardly decreasing diameter.

10. A sliding table cue-game piece according to claim 6, wherein said generally disk-shaped body has a center of gravity that is below the upper limit of said zone of maximum body diameter.

11. A cue-game comprising a table having a substantially horizontal playing surface and being surrounded by uncushioned walls, a plurality of game pieces adapted for sliding movement on said playing surface, and at least one cue for projecting said pieces over said playing surface, each of said game pieces comprising a circular, generally disk-shaped body having uppermost and lowermost surfaces, said body having a vertical axis that is substantially normal to the horizontal plane of said playing surface, and a total height that is less than the maximum diameter of said body, said maximum diameter being confined within a circumferential relatively narrow zone that is vertically spaced from both the uppermost and the lowermost surfaces and has an upper limit which is located at a level which is below the median level of the total body height and forming a caroming surface, said body including a central body portion having an upper limit at said uppermost surface of said body, and an annular outer skirt portion encircling said central body portion and projecting outwardly and downwardly from said upper limit thereof to define a radially resilient upwardly tapered sleeve surrounding at least a portion of the height of said central body portion in radially spaced relationship thereto and forming a cue-striking surface on said game piece, said sleeve converging upwardly toward said vertical axis of said central body at an angle of at least 15°, and said un-cushioned walls having a height that is less than the total height of each of said game pieces and an inwardly facing game piece-reflecting rebound surface leaning inwardly over said playing surface at an angle less than said first-mentioned angle.

* * * * *